US010980329B1

(12) United States Patent
Pham et al.

(10) Patent No.: US 10,980,329 B1
(45) Date of Patent: Apr. 20, 2021

(54) ACRYLIC POWDER DISPENSING PEN PROVIDING INFECTION PREVENTION FOR COVID-19 AND THE LIKE

(71) Applicants: Ben Thai Pham, Lawrenceville, GA (US); Kristy Tran, Lawrenceville, GA (US)

(72) Inventors: Ben Thai Pham, Lawrenceville, GA (US); Kristy Tran, Lawrenceville, GA (US)

( * ) Notice: Subject to any disclaimer, the term of this patent is extended or adjusted under 35 U.S.C. 154(b) by 0 days.

(21) Appl. No.: 17/097,281

(22) Filed: Nov. 13, 2020

Related U.S. Application Data

(63) Continuation of application No. 17/060,679, filed on Oct. 1, 2020, now abandoned.

(60) Provisional application No. 62/940,225, filed on Nov. 25, 2019.

(51) Int. Cl.
*A45D 33/02* (2006.01)
*B05B 11/04* (2006.01)
*A45D 29/00* (2006.01)

(52) U.S. Cl.
CPC ..... *A45D 33/02* (2013.01); *A45D 29/00* (2013.01); *B05B 11/041* (2013.01); *B05B 11/047* (2013.01); *B05B 11/048* (2013.01)

(58) Field of Classification Search
CPC ..... A45D 33/02; A45D 33/34; A45D 33/36; A45D 33/00; A45D 33/005; A45D 29/00; A45D 24/26; A45D 24/22; B05B 11/04; B05B 11/041; B05B 11/045; B05B 11/047; B05B 11/048; B05B 11/06; B05B 11/062; B05B 11/061; A46B 11/0041; B43K 5/04; B65D 83/06; B65D 47/42; B65D 47/44; B65D 35/28; B65D 35/36; B65D 35/38; B65D 1/32
USPC ..... 401/144, 145, 152, 156, 183–186; 222/630–633
See application file for complete search history.

(56) References Cited

U.S. PATENT DOCUMENTS 29,699 A * 8/1860 Isaacsen ..... B65D 83/06 222/189.02
1,909,802 A * 5/1933 Bass ..... B05B 11/041 222/183
2,551,676 A * 5/1951 Hoffman ..... B05B 11/041 222/150
2,578,864 A * 12/1951 Tupper ..... B05B 11/041 222/215
2,734,665 A * 2/1956 Flamm ..... F16N 3/06 222/207
3,480,020 A * 11/1969 Ernest ..... A45D 29/00 132/74.5

(Continued)

FOREIGN PATENT DOCUMENTS

CN 203023623 U * 6/2013 ..... F16K 51/00

*Primary Examiner* — Patrick M. Buechner
(74) *Attorney, Agent, or Firm* — Christopher Pilling

(57) ABSTRACT

An acrylic powder dispensing pen providing infection prevention such as COVID-19 and the like eliminates the need for nail dipping into acrylic powder jars at a nail salon. The dispensing pen has ergonomic body and an acrylic powder container configured to be coupled to the ergonomic body. The ergonomic body has a nozzle to dispense acrylic powder during use. A flow control area positioned is configured to be manipulated by the user, via finger pressure, to control of a flow rate of the acrylic powder being dispensed from the nozzle.

10 Claims, 4 Drawing Sheets

(56) References Cited

U.S. PATENT DOCUMENTS

| | | | | |
|---|---|---|---|---|
| 4,279,527 | A * | 7/1981 | Moe | A45D 34/042<br>401/186 |
| 8,245,958 | B2 * | 8/2012 | Ko | B05B 11/06<br>239/650 |
| 2004/0262340 | A1 * | 12/2004 | Kress | A45D 33/02<br>222/633 |
| 2007/0269255 | A1 * | 11/2007 | Marcellus | A61M 35/003<br>401/188 R |
| 2011/0066132 | A1 * | 3/2011 | Ji | A61M 11/008<br>604/500 |
| 2012/0279993 | A1 * | 11/2012 | Lott | A45D 19/02<br>222/189.02 |
| 2014/0314464 | A1 * | 10/2014 | Huang | A45D 40/26<br>401/68 |
| 2016/0143415 | A1 * | 5/2016 | Laaly | A45D 34/042<br>401/193 |
| 2018/0168315 | A1 * | 6/2018 | Strickland | A45D 29/17 |

* cited by examiner

ACRYLIC POWDER DISPENSING PEN PROVIDING INFECTION PREVENTION FOR COVID-19 AND THE LIKE

CROSS-REFERENCE TO RELATED APPLICATIONS

The present application claims priority to provisional application 62/940,225, filed on Nov. 25, 2019 entitled "Acrylic Powder Dispensing Pen", the disclosure of which is hereby incorporated in its entirety at least by reference.

BACKGROUND OF THE INVENTION

1. Field of the Invention

The present invention relates acrylic powders but more particularly to an acrylic powder dispensing pen.

2. Description of Related Art

Acrylic powders also referred to as "dipping powder," typically come housed in containers with a volume of 1-2 ounces and can come in a variety of colors and pigments.

The most common type is Ethylene Glycol Dimethacrylate, Poly Methyl Methacrylate, Dibenzoyl Peroxide Acrylic Easter Polymer. Dipping powder the latest trend in the Nail Industry. It had replaced the Old Acrylic Nail System. The old system worked by acrylic and polymer liquid mix. Nail technicians then form and shape acrylic to the nail bed of the desired length. With the Dipping System instead of using polymer, it used a specific type of glue and different method. This special glue will apply right over the nail bed of the desired length and shape. Then, the nail technician then would dip the fingernails into the powder. When dipping powder contacted the glue the nail bed it starts to harden. This process is repeated until the desired thickness is obtained. These two systems have been around for many years. There had been many cases of disease transmission from client to client by dipping the fingers to the same powder acrylic jar. Many states have banned this dipping system because of unsanitary. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention an acrylic powder dispensing pen providing infection prevention is provided, the dispensing pen comprising an ergonomic body having a first end and a second end, wherein the ergonomic body is shaped to receive the hand of a user; a removable container configured to be coupled to the first end of the ergonomic body, wherein the container is configured to house acrylic powder for use with the dispensing pen; the second end of the ergonomic body defining a nozzle, wherein the nozzle is configured to dispense acrylic powder during use; the ergonomic body having an interior defining a flow channel, wherein the flow channel provides a conduit enabling the acrylic powder to travel from the removable container to the nozzle; and, a flow control area positioned on the ergonomic body, wherein the flow control area is a pliable region on the ergonomic body configured to be manipulated by the user, via finger pressure, to control of a flow rate of the acrylic powder being dispensed from the nozzle.

In one embodiment, the removable container is configured to be threaded into the first end of the ergonomic body. In another embodiment, the nozzle is configured to receive a number of nozzle tips of various shapes and sizes. In one embodiment, the nozzle comprises a magnetic ring and each of the number of nozzle tips is configured to magnetically couple to the magnetic ring. In yet another embodiment, the interior of the ergonomic body contains flow limiting material positioned within the flow channel to control the flow rate of the acrylic powder. In one embodiment, the ergonomic body is comprised of pliable and rigid materials. In one embodiment, the flow control area is constructed of pliable rubber.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an acrylic powder dispensing pen providing infection prevention for covid-19 and the like.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Figure 1:
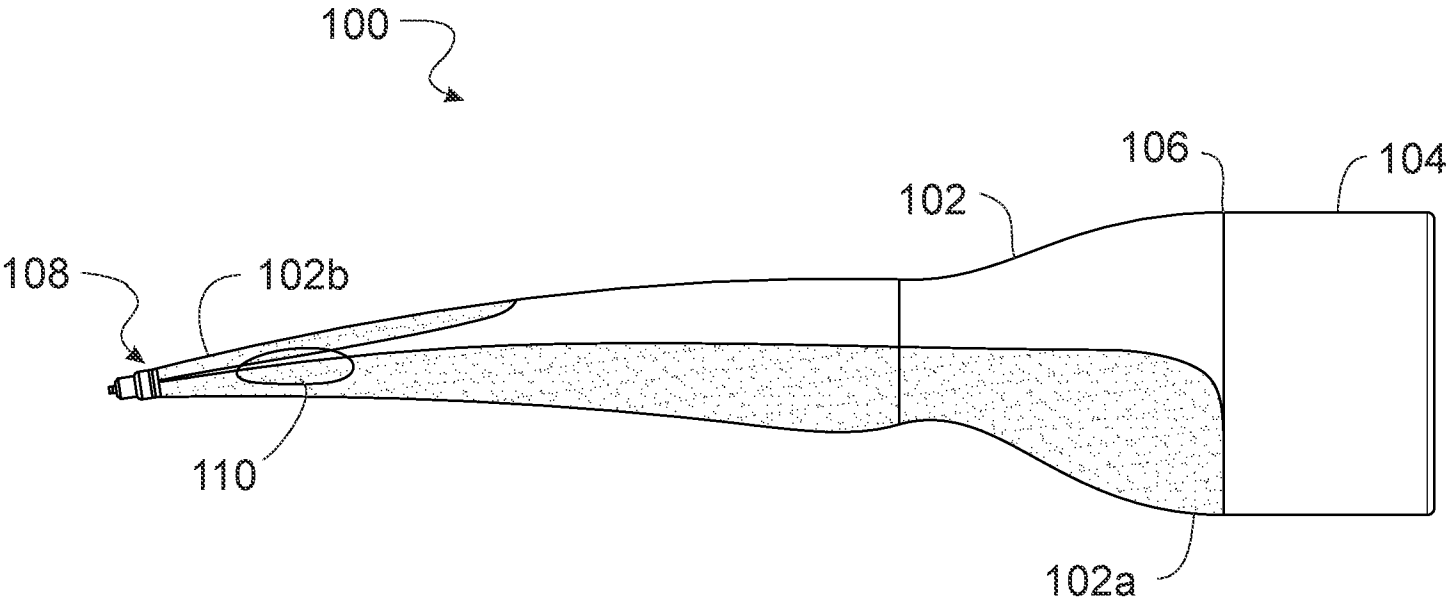
FIG. 1 is a left side view of an acrylic powder dispensing pen according to an embodiment of the present invention.
Figure 2:
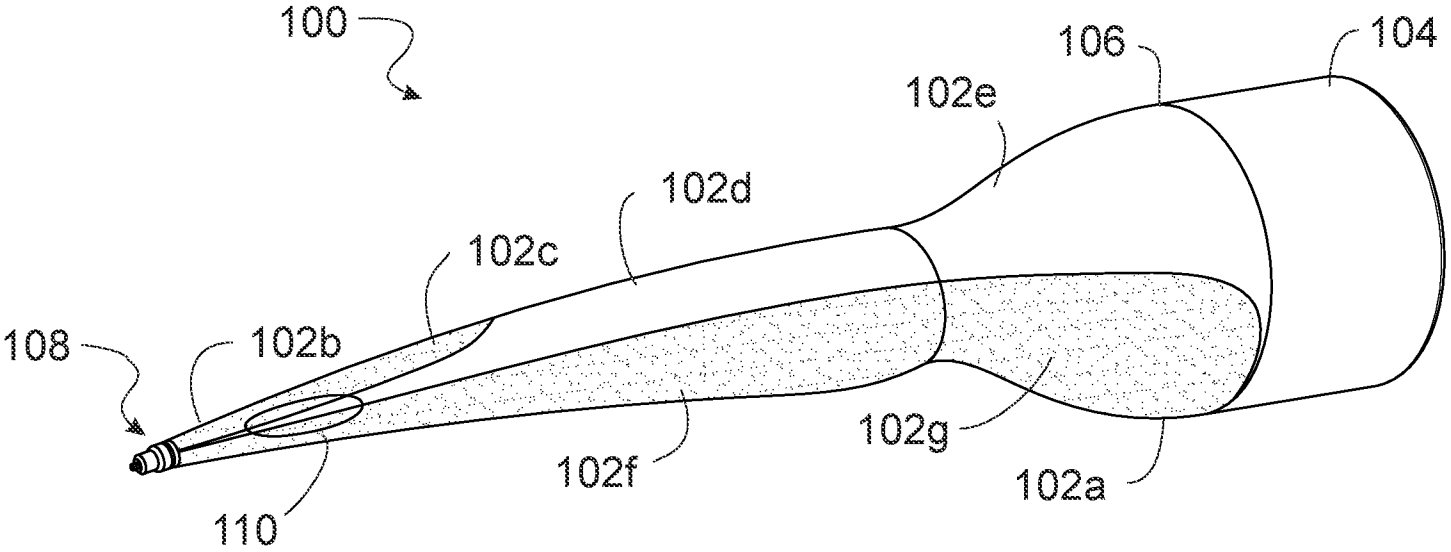
FIG. 2 is a top left side perspective view of the acrylic powder dispensing pen according to an embodiment of the present invention.
Figure 3:
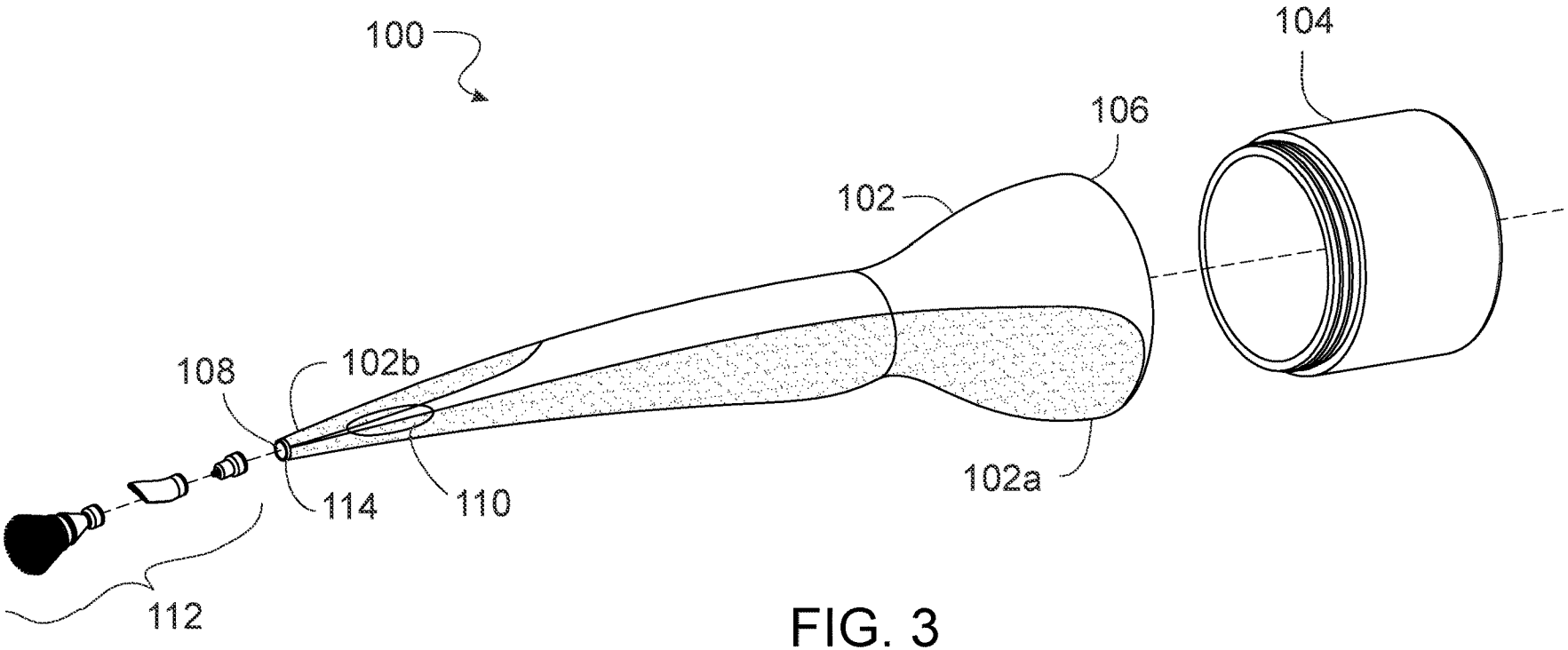
FIG. 3 is a top left side exploded perspective view of the acrylic powder dispensing pen according to an embodiment of the present invention.

FIGS. 1-3 are various views of an acrylic powder dispensing pen according to an embodiment of the present invention. Referring now to FIGS. 1-3, the acrylic powder dispensing pen 100 is illustrated. In one embodiment, the acrylic powder dispensing pen 100 comprises an ergonomic body 102 having a first end 102*a* and a second end 102*b*. The ergonomic body 102 is shaped to receive the hand of a user. In one embodiment, a container 104 is configured to be attached to the first end 102*a* of the body 102. The container 104 is configured to house acrylic powder for use with the dispensing pen 100. In one embodiment, the container 104 is configured to be threaded into the first end 102*a* of the body 102. In the illustrated example of FIG. 3, the container 104 comprises a male threaded end, and the first end 102*a* of the body 102 comprises a female threaded end 106 defining an aperture allowing acrylic powder to enter the interior of the body 102. It should be understood, that other means of attachments may be provided without departing from the spirit and scope of the invention. For example, magnetic attachment, snap-fit, or similar attachment means may be provided. In another embodiment, the container 104 may be an integral unit and built-in to the body, wherein the container could be refilled when necessary. However, there are several advantages of the provided configuration, including but not limited to, having the ability to be used with commercially available containers.

In one embodiment, the second end 102*b* of the body 102 comprises a nozzle 108, wherein the nozzle is configured to dispense acrylic powder during use. The material selection of the invention may vary. In one embodiment, the body 102 is configured from a pliable material, such as rubber, wherein the structure of the body 102 may be manipulated by the user. In some embodiments, only portions of the body are constructed from the pliable material. Other portions not configured to be manipulated may be constructed form a non-pliable or rigid material, such as hard plastic or non-pliable rubber. The portions of the body may be defined as a first portion 102*c*, a second portion 102*d*, a third portion 102*e*, a fourth portion 102*f*, and a fifth portion 102*g*. The first, second, and third portions are positioned on the top of the pen 100, extending from the second end 102*b* to the first end 102*a* of the body, and more specifically, the first portion 102*b* is near the second end 102*b*, the second portion 102*b* is centrally located between the ends, and the third portion is located near the first end 102*a* of the body. Likewise, the fourth portion 102*f* is positioned on the bottom side of the body extending from the second end 102*b* of the body towards the fifth portion 102*g* which is positioned on the bottom side towards the first end 102*a* of the body. In some embodiments, the first portion 102*c*, the fourth portion 102*f*, and the fifth portion 102*g* are constructed from a non-pliable material, such as hard rubber or plastic. In some embodiments, the second portion 102*d* is constructed from a high quality rubber, and the third portion 102*e* is construed from a plastic. It should be understood, that the material selection for each portion of the body may vary without departing from the spirit and scope of the invention.

The first end 102*a* of the body is conformed to expand in shape to match the shape of the container at the first end, wherein the second end 102*b* of the body is conformed to narrow in shape towards the nozzle 108. In one embodiment, the length of the body 102 is approximately 5-7 inches enabling the body to be of sufficient length to accommodate most hand sizes. It should be understood, that the length may be outside of the previously mentioned range, yet still operable to be handheld.

Advantageously, the present invention comprises a flow control area 110, providing a dedicated pliable region on or within the body to be manipulated by the user to control of the flow, and dispensing rate of acrylic powder throughout the device. In one embodiment, the flow control area is constructed of high quality rubber. More particularly, the flow of the acrylic powder is interrupted at a variable range when a user applies pressure to the flow control area 110, i.e. squeezes the flow control area 110. In one embodiment, the user's fingers, such as a pointer finger and thumb may be used to provide the pressure to the flow control area 110. The user has the ability to stop the flow of powder completely, limit the flow of powder, or provide no resistance to the flow of powder by controlling the amount of pressure applied to the flow control area 110.

In some embodiments, a variety of nozzle attachments 112 may be provided to control the spray, or dispensing of the acrylic powder during use. The variety of nozzle attachments may include, but are not limited to, spray, jet, wide mouth, brush, or other various shape, sizes, and tip configurations. The variety of nozzle attachments are configured to be replaced as necessary, providing another means to keep the device sanitary, especially if the nozzle attachment used makes contact with the nail of the patron during use by the user, i.e. the nail technician. In one embodiment, the each of the variety of nozzle attachments is magnetic and configured to magnetically attach to stainless magnetic ring 114, such that the selected nozzle attachment is removably coupled to the nozzle.

Figure 4:
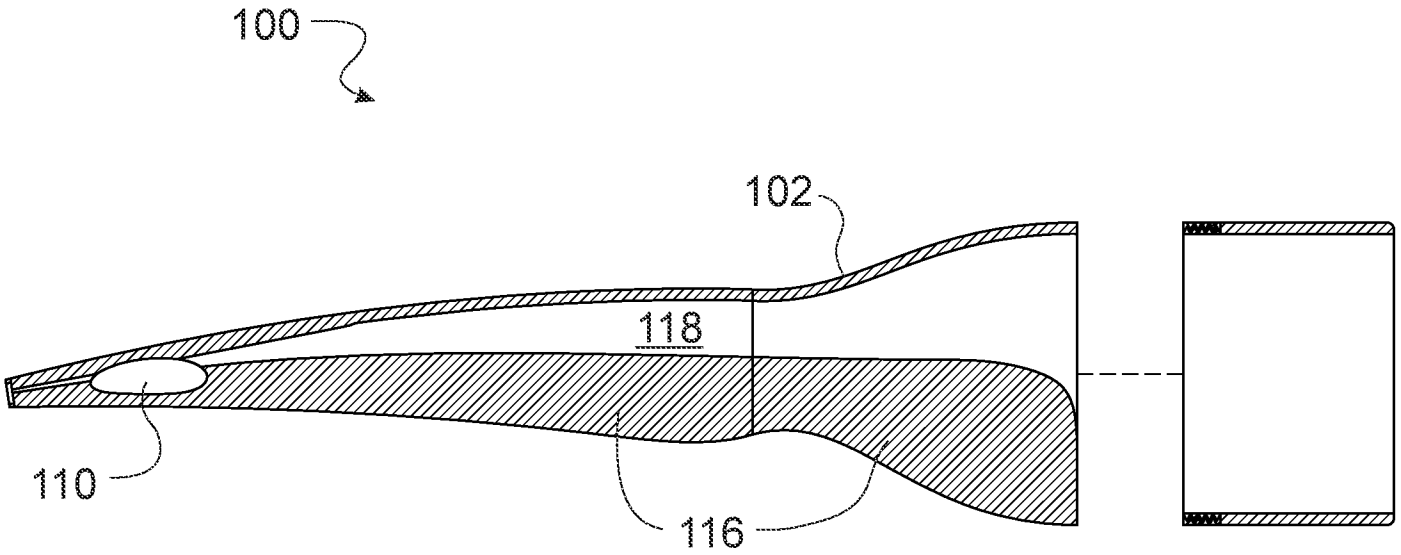
FIG. 4 is a section view of FIG. 1 with the container exploded from the body of the acrylic powder dispensing pen.

Referring now to FIG. 4, in some embodiments, the interior of the body 102 contains flow limiting material 116 positioned within the hollow portion of the interior to control the baseline flow rate of acrylic powder from the container to the nozzle 108 along the flow channel 118, wherein the baseline flow rate may be manipulated via the flow control area 110 by the user as previously discussed. In some embodiments, the flow limiting material 116 is comprised of one or more portions of the body.

The present invention enables a nail technician to no longer have to dip their client's nails into an unsanitary powder jar again. This present invention is configured to feed the acrylic powder over the nail bed of the client at the speed desired by the nail technician, wherein the speed or flow rate is controlled via the flow control area 110 as previously discussed. During a typical nail maintenance procedure using the present invention, first, a special type of glue that comes in clear or any colors glue is applied the nail bed. The nail technician will then use the present invention to feed the acrylic powder from the container to the client's nails bed. The acrylic powder may be selected from a variety of colors. The nail technician will be in full control of the speed and feed volume. Advantageously, the present invention enables one or more containers to be used and swapped out as needed to easily change the color of the acrylic powder during use. As previously mentioned, the body 102, and more particularly the female threaded end 106 is configured to enable most available powder containers on the market to attach to the body. Typically, these are 1 or 2 oz. containers. To swap containers, the dispensing pen 100 is positioned vertically, wherein the second end 102*b* of the body is positioned vertically above the first end 102*a* of the body such that any acrylic powder positioned in the flow channel 118 returns to the container 104.

The prevention invention provides confidence to patrons, clients that the salon owners and technicians that utilize the present invention meet state safety regulations, and the risk of infection is low.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An acrylic powder dispensing pen providing infection prevention, the dispensing pen comprising:

an ergonomic body having a first end and a second end, wherein the ergonomic body is comprised of a pliable region and a non-pliable region, wherein the non-pliable region is shaped to receive the hand of a user and at least a portion of the non-pliable region extends from the first end to the second end of the ergonomic body;

a removable container configured to be coupled to the first end of the ergonomic body, wherein the container is configured to house acrylic powder for use with the dispensing pen;

the second end of the ergonomic body defining a nozzle, wherein the nozzle is configured to dispense acrylic powder during use;

the ergonomic body having an interior defining a flow channel, wherein the flow channel provides a conduit enabling the acrylic powder to travel from the removable container to the nozzle; and, wherein the pliable region defines a flow control area, wherein the flow control area is configured to be manipulated by the user, via finger pressure, to control a flow rate of the acrylic powder being dispensed from the nozzle, wherein the flow control area is positioned between the first end and the second end and the flow control area is surrounded by the non-pliable region.

2. The acrylic powder dispensing pen of claim 1, wherein the removable container is configured to be threaded into the first end of the ergonomic body.

3. The acrylic powder dispensing pen of claim 1, wherein the interior of the ergonomic body contains flow limiting material positioned within the flow control area to control the flow rate of the acrylic powder.

4. The acrylic powder dispensing pen of claim 1, wherein the flow control area is constructed of pliable rubber.

5. The acrylic powder dispensing pen of claim 1, wherein the flow control area is positioned closer to the first end than the second end of the ergonomic body.

6. The acrylic powder dispensing pen of claim 1, wherein the ergonomic body has a length of approximately 5-7 inches enabling the ergonomic body to receive the hand of the user.

7. The acrylic powder dispensing pen of claim 1, wherein the first end is conformed to expand in shape to match the shape of the removable container at the first end, wherein the second end is conformed to narrow in shape towards the nozzle.

8. The acrylic powder dispensing pen of claim 1, wherein the nozzle is configured to receive a number of nozzle tips of various shapes and sizes.

9. The acrylic powder dispensing pen of claim 8, wherein the nozzle comprises a magnetic ring and the number of nozzle tips are configured to magnetically couple to the magnetic ring.

10. An acrylic powder dispensing pen providing infection prevention, the dispensing pen comprising:

an ergonomic body having a first end and a second end, wherein the ergonomic body is comprised of a pliable region and a non-pliable region, wherein the non-pliable region is shaped to receive the hand of a user;

a removable container configured to be coupled to the first end of the ergonomic body, wherein the container is configured to house acrylic powder for use with the dispensing pen;

the second end of the ergonomic body defining a nozzle, wherein the nozzle is configured to dispense acrylic powder during use;

the ergonomic body having an interior defining a flow channel, wherein the flow channel provides a conduit enabling the acrylic powder to travel from the removable container to the nozzle; and, wherein the pliable region defines a flow control area wherein the flow control area is configured to be manipulated by the user, via finger pressure, to control a flow rate of the acrylic powder being dispensed from the nozzle, wherein the flow control area is surrounded by the non-pliable region and positioned between the first end and the second end.

* * * * *